US005511519A

United States Patent [19]

Watson et al.

[11] Patent Number: 5,511,519

[45] Date of Patent: Apr. 30, 1996

[54] TEMPERATURE ADJUSTING AUTOMATIC CHOKE SYSTEM

[75] Inventors: Christopher L. Watson, Rock Hill; John A. Morrow, Fort Mill, both of S.C.

[73] Assignee: Homelite, Inc., Charlotte, N.C.

[21] Appl. No.: 271,007

[22] Filed: Jul. 5, 1994

[51] Int. Cl.[6] ..... F02M 1/10

[52] U.S. Cl. ..... 123/179.18; 261/39.4; 261/64.4

[58] Field of Search ..... 123/179.18, 437, 123/179.16; 261/39.4, 64.4

[56] References Cited

U.S. PATENT DOCUMENTS

| | | | |
|---|---|---|---|
| 1,317,047 | 9/1919 | Shields et al. | 261/66 |
| 1,612,597 | 12/1926 | Alexandrescu | 261/64.6 |
| 1,996,245 | 4/1935 | Hunt | 261/39.3 |
| 2,124,778 | 7/1938 | Hunt | 123/179.16 |
| 2,127,653 | 8/1938 | Sisson | 123/179.16 |
| 3,807,709 | 4/1974 | Suda et al. | 261/39.2 |
| 5,299,548 | 4/1994 | Beall | 123/586 |

OTHER PUBLICATIONS

Encyclopedia of Chemical Technology, John Wiley & Sons Inc., vol. pp. 726–728, 1982. (month unknown).

Encyclopedia of Chemical Technology, John Wiley & Sons Inc., vol. pp. 106–107, 1983. (month unknown).

*Primary Examiner*—Andrew M. Dolinar

*Attorney, Agent, or Firm*—Perman & Green

[57] ABSTRACT

An air inlet control system for a carburetor of an internal combustion engine. The system includes a magnet, an air inlet valve, and a temperature controlled limiter. The magnet is used to automatically attract the air inlet valve towards a fully closed position. The temperature controlled limiter limits the range of movement of the air inlet valve based upon the temperature of the engine. The limiter limits the open position of the valve to a position less than fully open when the engine is cold and, limits the closed position of the valve to a position less than fully closed when the engine is hot.

23 Claims, 7 Drawing Sheets

TEMPERATURE ADJUSTING AUTOMATIC CHOKE SYSTEM

BACKGROUND OF THE INVENTION

1. Field of the Invention

The present invention relates to internal combustion engines and, more particularly, to an air inlet system for a carburetor.

2. Prior Art

U.S. Pat. No. 1,996,245 discloses using a permanent magnet to exert a force on a lever that controls a choke valve, and a thermostat that also controls the choke valve. A slot in a link is also disclosed to limit movement of the choke valve. U.S. Pat. Nos. 1,317,047 and 1,612,597 discloses other types of carburetors.

SUMMARY OF THE INVENTION

In accordance with one embodiment of the present invention an air inlet control system for an internal combustion engine is provided. The system comprises an air inlet valve and a temperature control limiter. The limiter is adapted to limit a range of movement of the inlet valve based upon temperature at a cylinder area of the engine. The limiter comprises a temperature responsive element for positioning at the cylinder area and a mechanical linkage from the temperature responsive element to the air inlet valve.

In accordance with another embodiment of the present invention an air inlet control system for an internal combustion engine is provided comprising an air inlet valve and a temperature responsive limiter. The air inlet valve has a first end adapted to close an air inlet aperture and a second end with a limiter receiving area. The temperature responsive limiter has a lever and a tie member. The lever has a first end located in the limiter receiving area. The tie member is connected to the lever and has an end for positioning at a predetermined portion of the engine. The tie member is comprised of a temperature responsive material with an elongate straight shape adapted to longitudinally contract when heated and expand back to its normal size when cooled.

In accordance with another embodiment of the present invention an internal combustion engine is provided comprising a cylinder, a spark plug, a carburetor and an air inlet control system for the carburetor. The control system comprises a magnet, an air inlet valve, and a limiter. The air inlet valve is movable between a fully open position and a fully closed position. The valve has a first ferromagnetic section adapted to be attracted by the magnetic pull of the magnet when the valve is proximate its fully closed position, and a second section with a limiter receiving area. The limiter has a limit member with a first end located in the limiter receiving area. The limit member is movable between a first position and a second position. The first position limits movement of the valve to include an open position that is less than the fully open position. The second position limits movement of the valve to include a closed position that is less than the fully closed position.

BRIEF DESCRIPTION OF THE DRAWINGS

The foregoing aspects and other features of the invention are explained in the following description, taken in connection with the accompanying drawings, wherein.

DETAILED DESCRIPTION OF THE INVENTION

Figure 1:
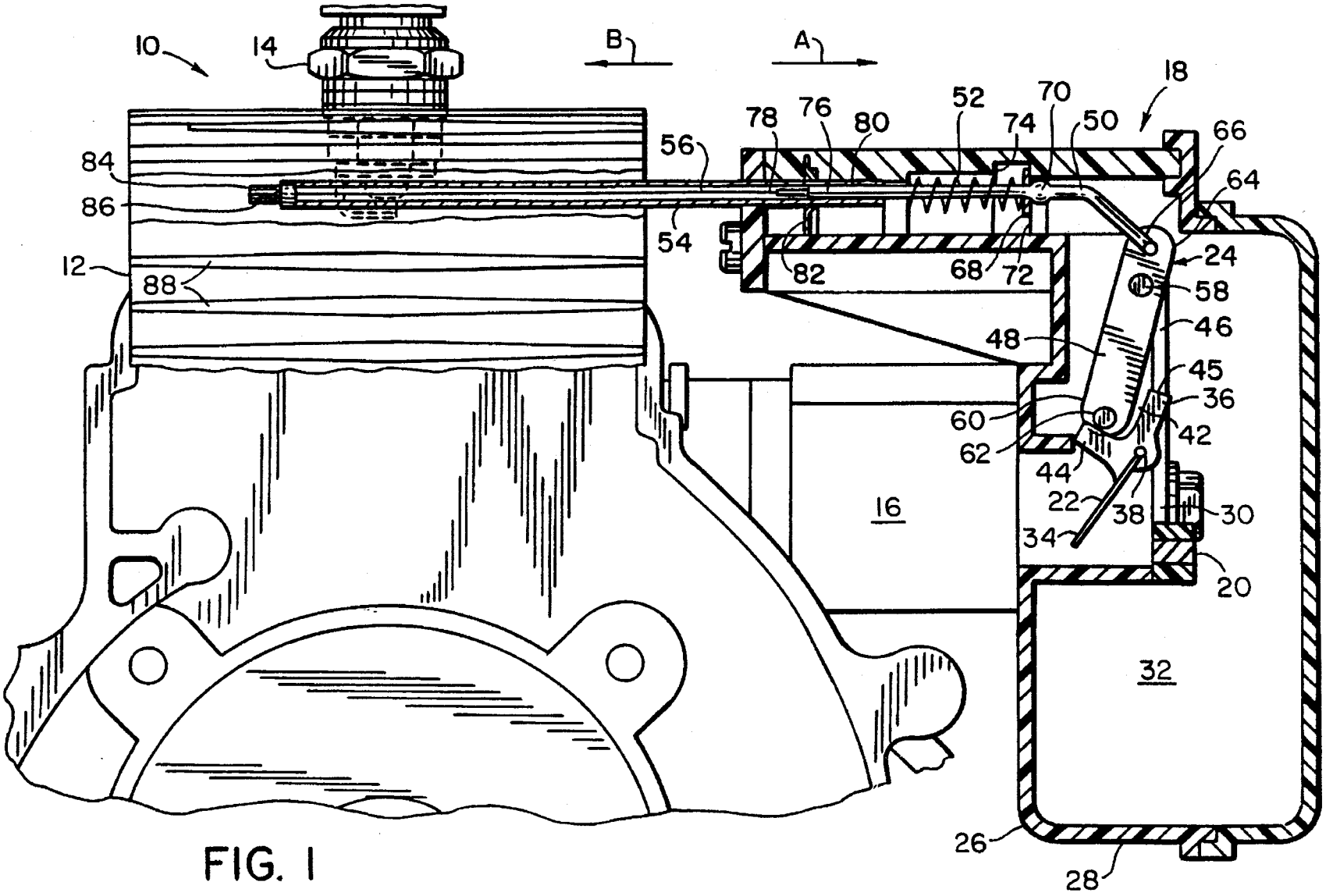
FIG. 1 is a partial schematic view, showing some areas in sectional view, of an internal combustion engine incorporating features of the present invention.

Referring to FIG. 1, there is shown a schematic view, with portions shown in cross section, of a portion of an internal combustion engine 10 incorporating features of the present invention. Although the present invention will be described with reference to the embodiments shown in the drawings, it should be understood that features of the present invention can be embodied in various different forms and types of alternate embodiment. In addition, any suitable size, shape and type of elements or materials could be used.

The engine 10 is a two cycle engine with a cylinder 12, spark plug 14, carburetor 16, and an air inlet system 18 for the carburetor 16. The present invention could also be used in a four cycle engine. In addition, other elements of the engine 10 which are conventional and well known are not described herein for the sake of clarity and simplicity. In the embodiment shown, the air inlet system 18 generally comprises a magnet 20, an air inlet valve 22, and a temperature controlled limiter 24. The magnet 20, valve 22, and part of the limiter 24 are attached to and contained in a frame 26 that also forms part of the air filter 28 for the engine 10. However, in alternate embodiments, these components of the air inlet system 18 could be fully contained as part of the carburetor assembly.

Figure 3:
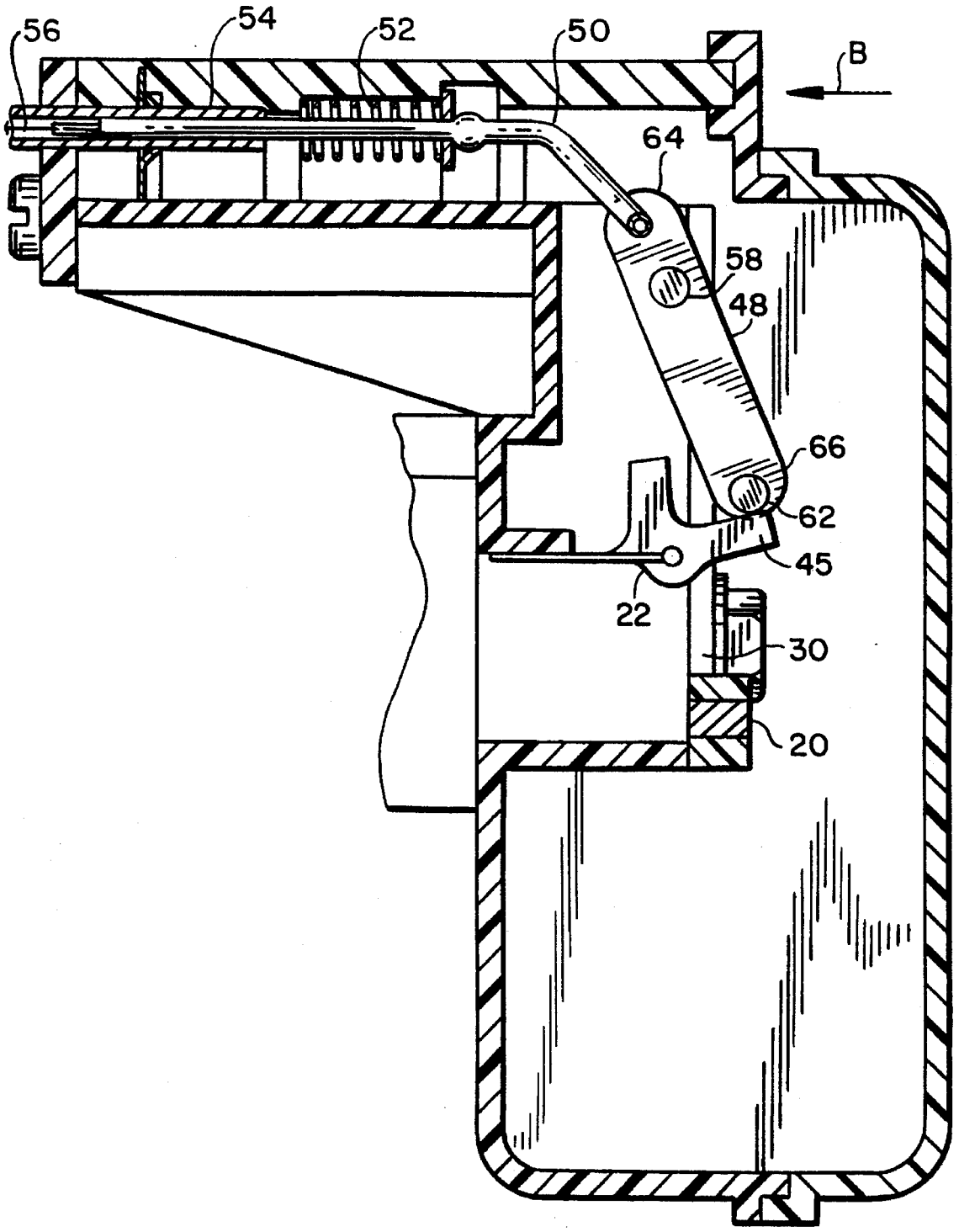
FIG. 3 is a sectional view of the air inlet system as shown in FIG. 2 with the air inlet valve at a fully open position.
Figure 4:
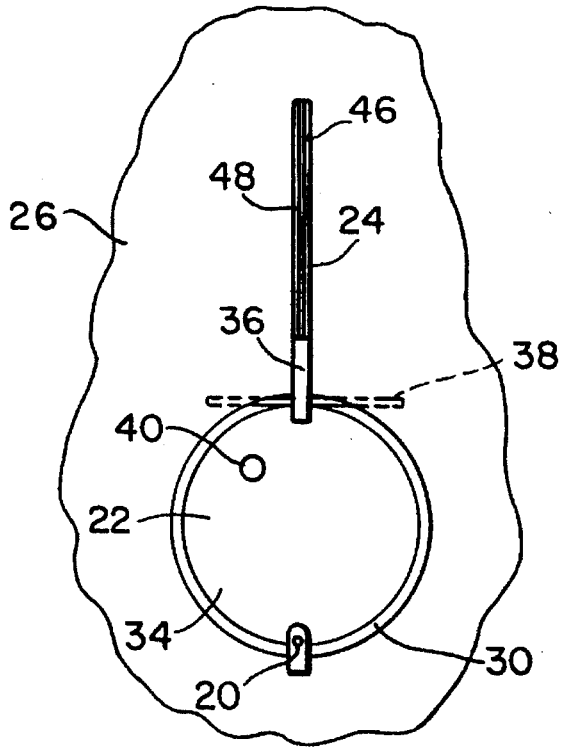
FIG. 4 is an elevational view of the air inlet aperture taken in the direction of arrow C in FIG. 2.

Referring also to FIG. 4, the frame 26 forms an air inlet aperture 30 between a central area 32 of the air filter 28 and the carburetor 16. The magnet 20 is stationarily connected to the frame 26 at the bottom of the inlet aperture 30. The valve 22 is pivotably mounted to the frame 26 by a pin 38. The valve 22 is movable between a fully closed position (illustrated in FIG. 2) and a fully open position (illustrated in FIG. 3). The valve 22 has a first section 34 and a second section 36. The first section 34 is comprised of ferromagnetic material and has a general flat plate-like shape. A port 40 may also be provided in the first section 34 if desired. The first section's primary function is to function as a choke valve at the inlet aperture 30. The function of a choke valve is very well known and, therefore, will not be described further. The second section 36 has a general "L" shape forming a limiter receiving area 42 between its two legs 44, 45. The frame 26 also has a slot 46 at the top of the inlet aperture 30 to allow the second leg 45 to move therein.

The limiter 24 generally comprises a lever 48, a connector 50, a spring 52, a tube 54, and a temperature responsive element 56. The lever 48 is pivotably mounted to the frame 26 at pin 58. The lever 48 has a first end 60 with a pin 62, and a second end 64. The pin 62 is located in the receiving area 42 of the valve 22 between the two legs 44, 45. The connector 50 has a first end 66 connected to the level second end 64. The lever 48 is pivotably mounted on the pin 58 between a first position, shown in FIGS. 1 and 2, when the engine 10 is cold, and a second position, shown in FIG. 3, when the engine 10 is hot. The slot 46 in the frame 26 allows the ends 60, 64 to freely move into and out of the slot 46. This allows the lever 48 free movement. As seen in comparing FIGS. 1 and 2, the pin 62 and receiving area 42 are suitably sized relative to each other such that the valve 22 can move relative to the lever 48. However, the lever 48 can limit the range of the movement of the valve 22 relative to the inlet aperture 30. This is discussed in further detail below.

The spring 52 biases the connector 50, relative to the frame 26, in a first direction indicated by arrow A. This is accomplished by means of the spring 52 pressing against washer 68 that presses against enlarged section 70 of the connector 50. Wall 72 of the frame 26 limits movement of the washer 68. This limits pushing action of the spring and movement of the connector 50 in the direction A. Prestrain memory of the element 56 limits the normal operational movement of the connector 50 in an opposite second direction B (see FIG. 3). However, a second wall 74 can also function as a limit by stopping washer 68 if a user inadvertently manually moves the connector 50. The second end 76 of the connector 50 slidingly projects into the tube 54. A first end 78 of the element 56 is fixedly connected to the connector second end 76. A first end 80 of the tube 54 is stationarily held on the frame 26 by a retainer 82. The opposite second end 84 of the tube 54 has the second end 86 of the element 56 stationarily connected thereto. The tube 54 generally provides three functions. First, the tube functions as a cover for the element 56 to prevent the element 56 from damage. Second, the tube 54 functions as an anchor for the second end 86 of the element 56 to be fixed to. Because the tube 54 is fixed to the frame, this fixes the second end 86 relative to the frame 26. Third, the tube 54 functions as a guide for the sliding movement of the connector second end 76 inside the tube. The tube 54 is made of a suitable material, such as copper, that can transfer heat from the cylinder 12 to the element 56. The tube 54 is suitably sized to fit between cooling fins 88 on the exterior of the cylinder. In alternate embodiments, the tube could be located at any suitable predetermined position on or in the engine 10 to respond to temperature changes of the engine at that location. Location of the tube at the top of the cylinder 12 is a preferred embodiment. This is because the temperature of the cylinder has the greatest effect on combustion in the cylinder. Thus, it is the most accurate location to use as a gauge to limit adjustment of the valve 22. Limiting adjustment of the valve 22 can affect the air/fuel mixture delivered by the carburetor 16 to the cylinder 12.

In the embodiment shown, the element 56 is comprised of an elongate member that functions similar to a cable or tie member between the second end 84 of the tube 54 and the second end 76 of the connector 50. In a preferred embodiment, the element 56 is comprised of nitinol wire. Nitinol consists of a group of Ti—Ni alloys that was developed by the Navy in the early 1960's for F-14 fighter jets. Nitinol was originally an acronym for Nickel-Titanium Naval Ordnance Laboratory, but is now a term used to identify Ti—Ni shape memory alloys. The shape-memory effect of such alloys is based on the continuous appearance and disappearance of martensite with falling and rising temperatures. Martensite is a metastable phase that forms when a phase stable at elevated temperature is cooled at a certain rate, thereby suppressing the formation of phases that are diffusion controlled. This is a thermoelastic behavior. A number of other characteristics associated with shape memory are referred to as pseudoelasticity or superelasticity, two-way shape-memory effect, martensite-to-martensite transformations, and rubber-like behavior. Other types of shape-memory alloys are known in the alloy materials industry. Nitinol wire can have a transition temperature ranging from −100° C. to greater than 100° C. The transition temperature is controlled by additional alloying elements.

The martensite start temperature is the temperature at which martensite starts to form on cooling an austenite specimen. The martensite finish temperature is a lower temperature at which an elevated temperature phase has been completely transformed and the martinsite reaction is complete. On heating a martensite specimen, the temperature at which the reaction reverses to the elevated temperature phase is the austenite start temperature. Austenite reaction is complete at a higher austenite finish temperature. For the embodiment shown, the element 56 is made of nitinol wire with an austenite start temperature of about 50° C.–65° C., an austenite finish temperature of about 80° C.–95° C., a martensite start temperature of about 65° C.–50° C., and a martensite finish temperature of about 40° C.–25° C. These temperatures are given for illustrational purposes only. Relatively small contraction and expansion of the length of the wire, such as less than 0.5% of the total length of the wire, can occur before and after transition. The above temperatures are given to illustrate when relatively large length changes of the wire start and stop. In alternate embodiments, other types of nitinol wire could be provided that have different austenite and martensite temperatures. In the embodiment shown, the nitinol wire 56 is FLEXINOL. FLEXINOL is a trademark of Dynalloy, Inc. of Irvine, Calif. The maximum temperature of the wire 56 should not exceed 300° C. because, above this temperature, crystal growth begins to occur and consistent shape memory performance deteriorates. The transition temperature also changes with stress. Thus, based upon the amount of stress that the spring 52 exerts on the wire 56, the transition temperatures can be varied. Hence, different springs could be used to vary or configure the system's transition temperatures. For the transition temperatures mentioned above, the wire 56 was subjected to a load of 15,000 psi of cross sectional area. The percentage of extension and contraction of the wire 56 is about 4.5% of its length.

Figure 2:
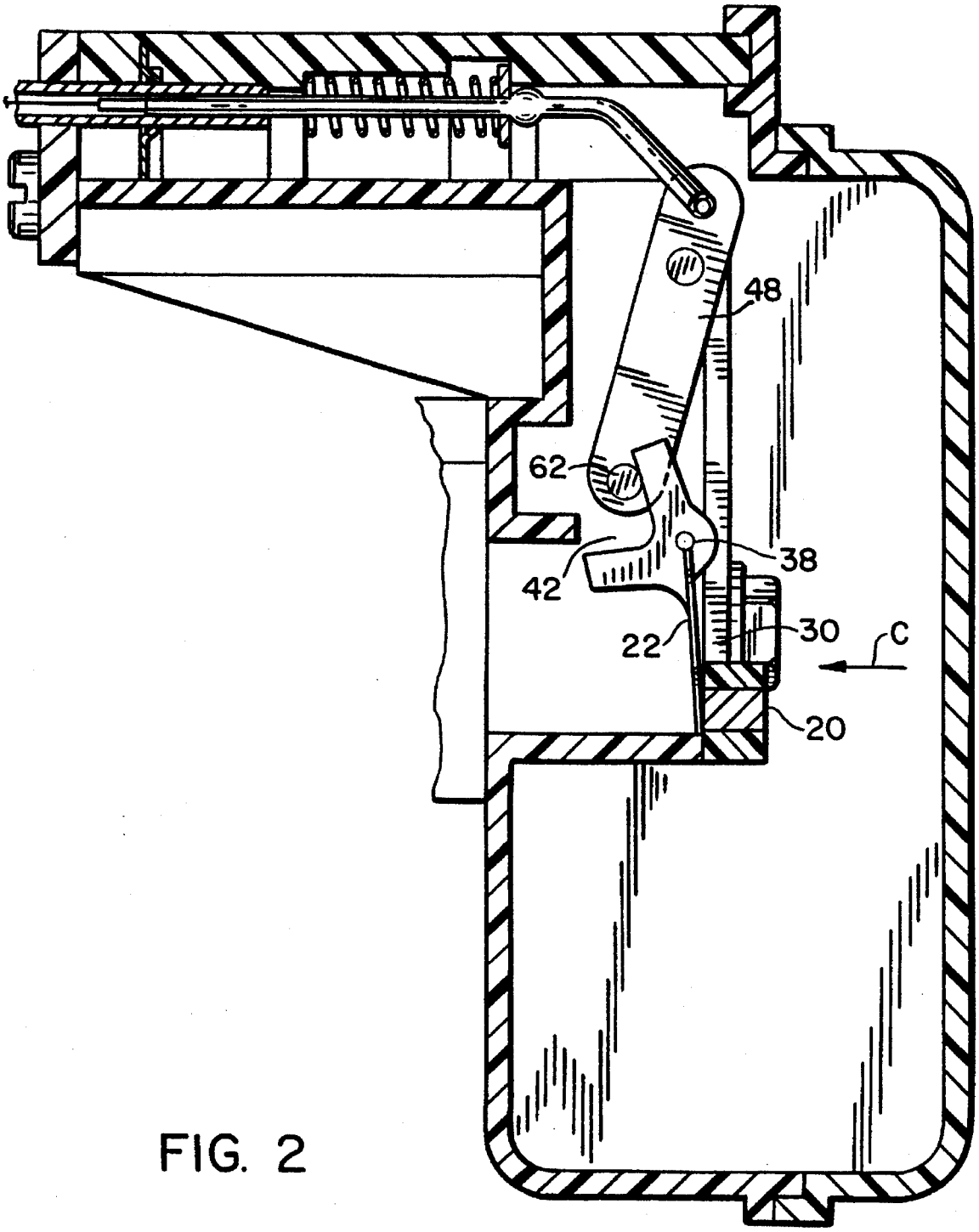
FIG. 2 is a sectional view of the air inlet system shown in FIG. 1 with the air inlet valve at a fully closed position.

Referring now to FIGS. 1, 2 and 4, the limiter 24 is shown at a first position. This first position occurs when the temperature of the cylinder 12 is cold and the wire 56 is completely martensite. It should be understood that, as used herein, the term "cold" is intended to mean a temperature at the cylinder 12 of less than the austenite start temperature. In addition, the term "hot" is intended to mean a temperature at the cylinder 12 equal to or greater than the austenite finish temperature. In the first position of the limiter 24, the spring 52 biases the connector 50 in the position shown. The connector 50, in turn, maintains the lever 48 at the position shown. The element 56 keeps the connector 50 from further movement in the direction A due to its connections at connector second end 76 and tube second end 84. Although the limiter 24 is shown at a single first position in FIGS. 1 and 2, the valve 22 is shown at two different positions. FIG. 2 is an illustration of when the engine is cold and is not operating. FIG. 1 is an illustration of when the engine is cold, but is operating. FIG. 2 shows the valve 22 at a fully closed position. In this fully closed position the magnetic pull of the magnet 20 helps to keep the valve 22 in the fully closed position until the engine is started. As seen in FIG. 4, the first section 34 of the valve substantially blocks the air inlet aperture 30. The pin 62 on the lever 48 does not affect the position of the valve 22 in this state.

Immediately after the engine 10 is started, the inherent vacuum downstream of the valve 22, caused by the engine operating, causes the valve 22 to be pulled away from the magnet 20. The valve 22 pivots at pin 38. Since magnetic force decreases by the square of the distance from the magnet, the problem of the magnet 20 attracting the valve under normal running conditions of the engine is eliminated. As seen with reference to FIG. 1, the inflow of air through air inlet aperture 30 pushes the first section 34 of the valve 22 back to an open position. However, with the limiter 24 at its first position, when the valve 22 pivots at pin 38, the first arm 44 of the valve second section 36 contacts the pin 62 on the lever 48. This stops the valve 22 from opening further. Thus, the open position of valve 22 in the cold operating state shown in FIG. 1 is not the fully open position. It is only a partially open position. Hence, an automatic partial-choke condition is provided in this cold operating state.

As the engine 10 continues to operate, the temperature at the cylinder 12 will rise. Heat from the cylinder 12 is transferred by the tube 54 and air in the tube 54 to the element 56. When the temperature of the element 56 reaches the austenite start temperature, the element 56 starts to thermoelastically longitudinally contract or shorten. Because the two ends 86, 78 of the element 56 are respectively attached to the tube 54 and connector 50, the tube 54 and connector 50 are moved relative to each other as the element 56 shortens. More specifically, because the tube 54 is fixed to the frame 26, the element 56 pulls the connector 50 further inside the tube 54. When the temperature of the element 56 reaches the austenite finish temperature, the element 56 stops contracting. As seen with reference to FIG. 3, this causes the connector 50 to move the lever 48 to the second position shown.

Referring also to FIG. 3, the air inlet system 18 is shown when the engine 10 is in a hot state or condition. This position of the air inlet system 18 exists whether or not the engine is operating. As can be seen, the element 56 and connector 50 have pulled, in the direction B, on the second end 64 of the lever 48 causing the lever 48 to pivot at the pin 58. This has moved the first end 66 of the lever 48. The pin 62 on the first end 66 contacts the second leg 45 and prevents the valve 22 from pivoting from the valve fully open position shown. Thus, even if the engine 10 is turned off, so long as the element 56 remains above the martensite start temperature, the valve 22 will be retained at its fully open position shown in FIG. 3. When the element 56 cools past the martensite start temperature, it enters the metastable phase and starts to lengthen, pulled by the spring 52, to return to its original length. The spring 52 biases the connector 50 back to the position shown in FIGS. 1 and 2 as the element further cools to the martensite finish temperature. This moves the lever 48 from its second position back to its first position. The valve 22 is thus able to return to its fully closed position shown in FIG. 2 through a combination of gravity and magnetic attraction when the valve gets close enough to the magnet 20 to be attracted.

If the engine 10 is started again during the cooling between the martensite start temperature and the martensite finish temperature, the lever 48 will remain substantially stationary until heat is transferred from the cylinder 12 to the element 56. As heat is transferred to the element 56 it will begin to shorten again. In the embodiment shown, where air in the tube 54 is used as a heat transfer medium, a delay of about 5 to 10 seconds can occur in heat transfer. However, in alternate embodiments, other forms of heat transfer or heat transfer mediums could be used, such as grease, liquid, etc. In a preferred embodiment, the delay in heat transfer should be as small as possible. Air is used as the heat transfer medium in the embodiment shown because the delay of 5 to 10 seconds is minimal and the system is relatively inexpensive to manufacture and assemble. However, when the engine is started again, because the lever receiving area 42 of the valve second 36 is larger than the pin 62, the inflow of air through the inlet aperture 30 will immediately move the valve 22 to at least a partially open position.

The present invention combines the features of the magnet 20 with the temperature control of the element 56 and design of the lever/valve interaction to provide an automatic choke or automatic air intake system for the engine 10. The system allows a cold engine to be started with an appropriate positioning of the valve 22 before (FIG. 2) and after (FIG. 1) starting. As the cylinder 12 warms up, the system 18 automatically allows the valve 22 to move from its partially open position shown in FIG. 1 to its fully open position shown in FIG. 3. If the engine 10 is stopped, but is still hot, the engine 10 can be restarted because the system 18 prevents the valve 22 from returning to its fully closed position. If the engine was still hot and the valve 22 returned to its fully closed position, the engine would not be able to restart because of an improper fuel/air mixture. Thus, the present invention provides a dependable and responsive automatic choke system for the engine.

Figure 5:
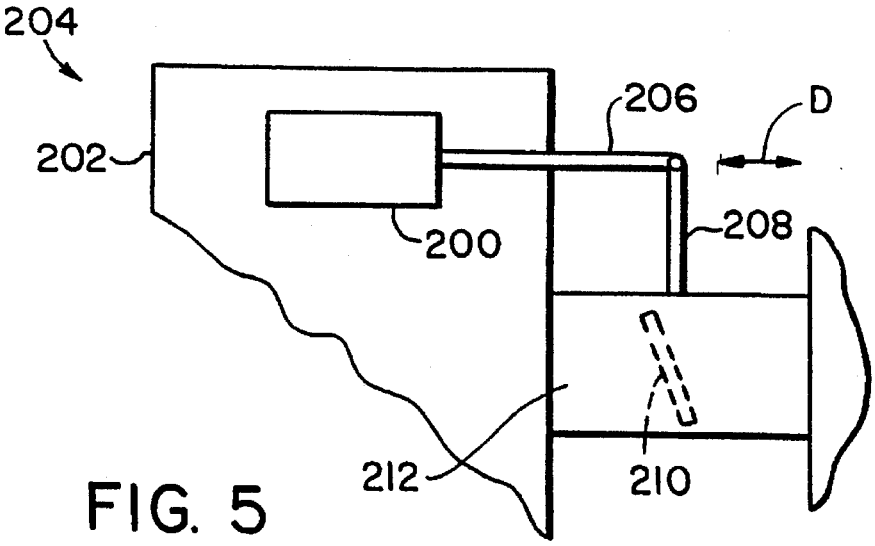
FIG. 5 is a schematic view of an alternate embodiment of the present invention.

Referring now to FIG. 5, a schematic view of an alternate embodiment of the present invention is shown. In the embodiment shown, a temperature responsive element 200 is attached to the cylinder head 202 of an engine 204. The temperature responsive element 200 could include a shape-memory alloy, a thermal wax cell, or a bi-metal component. The element 200 has a first connecting rod 206 that is attached to a second connecting rod 208. The second rod 208 is adapted to limit movement of a choke valve 210 inside the carburetor 212 to a predetermined range of positions dependent upon whether the cylinder head 202 is hot or cold. The element 200 moves the second rod 208, by means of the first rod 206, dependent upon temperature of the cylinder head 202. This embodiment is intended to illustrate that features of the present invention can be embodied in various different types of embodiments.

Figure 6A:
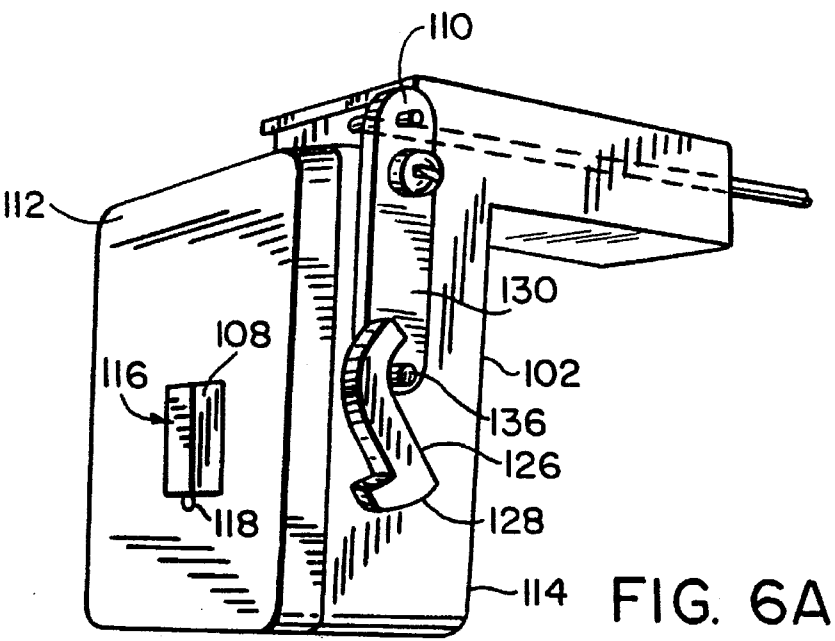
FIG. 6A is a schematic perspective view of a portion of an alternate embodiment of an air inlet system incorporating features of the present invention.
Figure 6C:
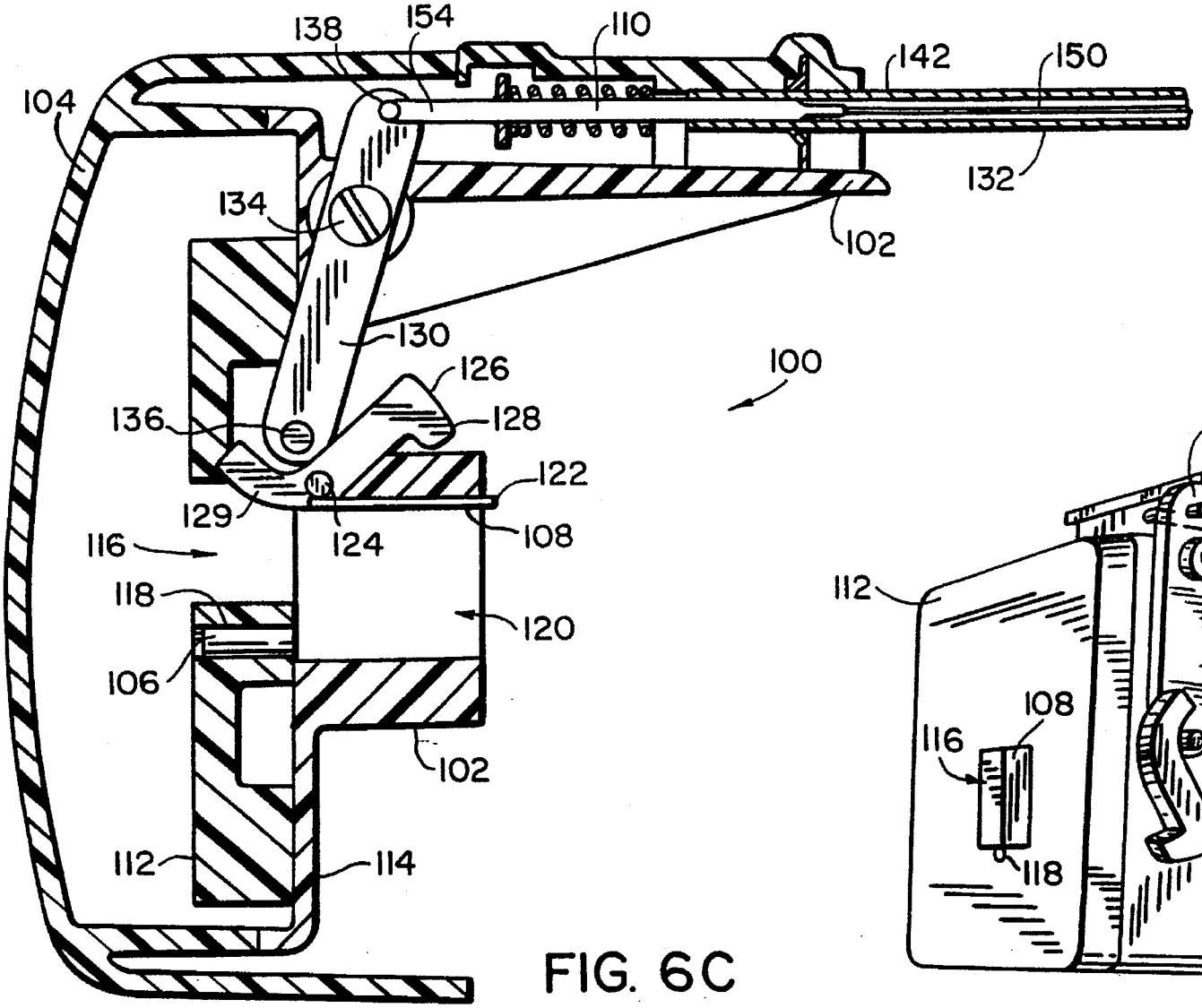
FIG. 6C is a schematic cross-sectional view of the system shown in FIG. 6B with the inlet valve at an open position.
Figure 6B:
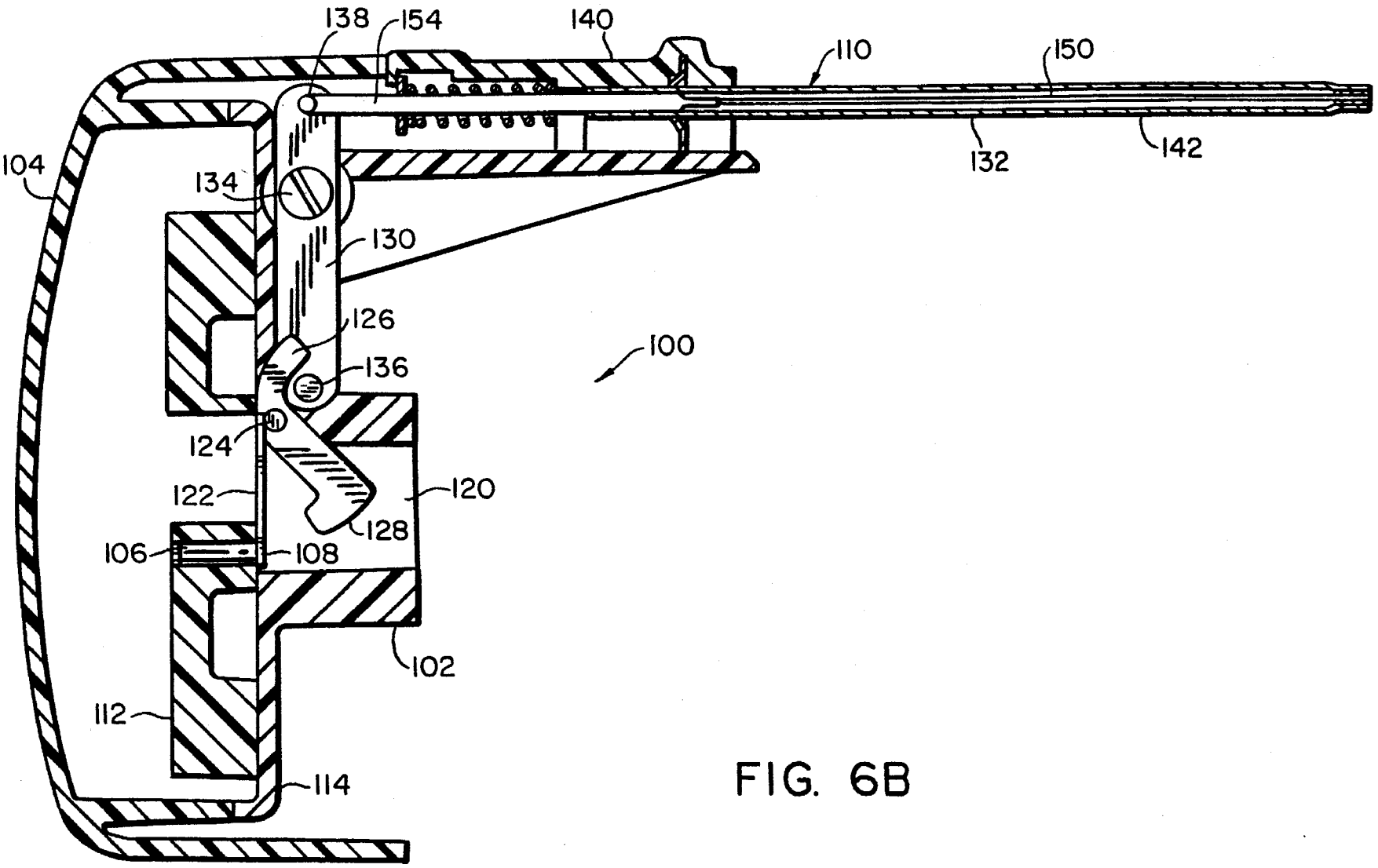
FIG. 6B is a schematic cross-sectional view of the system shown in FIG. 6A with the inlet valve at a closed position and showing positions of members of the temperature controlled limiter assembly.

Referring now to FIGS. 6A–6C, schematic illustrations of an alternate embodiment is shown. In the embodiment shown, the air inlet system 100 has a frame 102, an air filter cover 104, a permanent magnet 106, an air inlet valve 108, and a temperature controlled limiter assembly 110. The frame 102 has a cover 112 and a body 114. The cover 112 has an air inlet aperture 116 and a hole 118. The magnet 106 is mounted in the hole 118. The cover 112 is attached to the front of the body 114 by suitable means (not shown). The body 114 has an air inlet conduit 120. The valve 108 has a valve plate 122 and a pivot rod 124 fixedly attached thereto. The pivot rod 124 is pivotably connected to the body 114 with the plate 122 located in the conduit 120. Fixedly mounted to one end of the pivot rod 124 is an arm 126. The arm 126 has a general "L" shape with an enlarged end 128 that acts as a weight for allowing gravity to assist in positioning the valve 108. The plate 122, rod 124 and arm 126 all move as an integral or unitary part. The arm 126 is located on the exterior side of the body 114. The arm 126 is shown in FIGS. 6B and 6C for illustrative purposes only. The arm 126 would normally not be seen in the cross-sectional views shown. The limiter assembly 110 generally includes a lever 130 and an actuator assembly 132. The lever 130 is pivotably connected to the body 114, on the same exterior side as the arm 126, by a screw 134. Located at one end of the lever 130 is a projection 136. Located at the opposite end is a hole 138. The lever 130 is shown in FIGS. 6B and 6C for illustrative purposes only. The lever 130 would normally not be seen in the cross-sectional views shown. The projection 136 is located in the interior corner of the L-shaped arm 126 and, is adapted to make physical contact with the arm 126 to limit the arm's position on the body 114.

Figure 7:
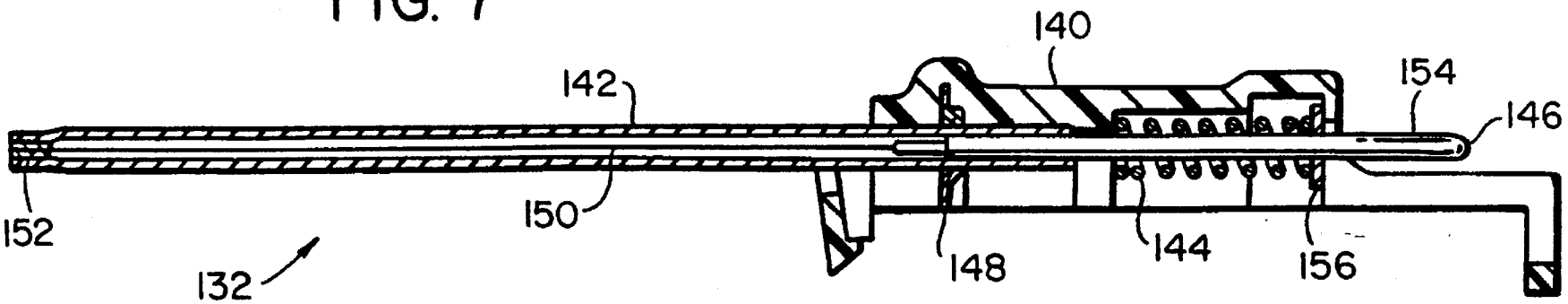
FIG. 7 is a schematic partial cross-sectional view of an actuator assembly of the temperature controlled limiter assembly shown in FIGS. 6A–6C.
Figure 7A:
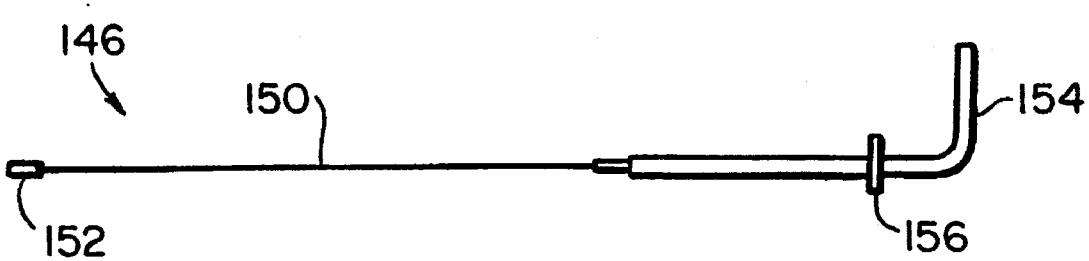
FIG. 7A is a top view of the element and connector assembly used in the actuator assembly shown in FIG. 7.

Referring also to FIG. 7, the actuator assembly 132 has a frame 140, a tube 142, a spring 144, and an element and connector assembly 146. The frame 140 is adapted to be removably connected to the body 114. The tube 142 is fixedly mounted to the frame 140 by a connector 148. The element and connector assembly 146, also seen in FIG. 7A, generally comprises a temperature responsive shape memory element 150, a splice 152, and a hook connector 154. The splice 152 is fixed to one end of the element 150. The connector 154 is fixed to the opposite end of the element 150. The connector 154 includes a washer 156. The splice 152 is fixed to one end of the tube 142 and the connector 154 slidably extends out of the other end of the tube 142. The spring 144 biases the washer 156, and thus biases the connector 154 in a direction away from the tube 142. The modularity of the actuator assembly 132 allows easier assembly of the temperature controlled limiter assembly 110. The end of the connector 154 is located in the hole 138 of the lever 130. Thus, the actuator assembly 132 is able to push and pull on one end of the lever 130.

FIG. 6B shows the system 100 with the temperature controlled limiter assembly 110 at a "cold" position and the valve 108 at a closed position. In other words, the engine is cold and not running. When the engine is started the valve 108 pops open (from the inflow of air), but only partially. The projection 136 stops the arm 126 from pivoting to a valve fully open position. Thus, a proper air/fuel mixture is provided for the "cold" engine.

FIG. 6C shows the temperature controlled limiter assembly 110 at a "hot" position and the valve 108 at a fully open position. In other words, the engine is hot and running. As seen in comparing FIG. 6B to FIG. 6C, when the engine heats up, the element 150 contracts to pull the connector 154 further into the tube 142. This moves the lever 130. This allows the arm 126 to move to a valve fully open position. If the engine is stopped, the weight of the end 128 will cause the valve 108 to pivot towards the closed position. However, because the engine is still hot, the end 129 will be stopped by the projection 136 to prevent the valve from returning to the fully closed position so long as the engine is hot. This embodiment, by locating the lever 130 and arm 126 outside the body 114, reduces air losses past the valve plate 122.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An air inlet control system for an internal combustion engine, the system comprising:

an air inlet valve; and a temperature controlled limiter, the limiter being adapted to limit a range of movement of the inlet valve based upon temperature of a cylinder of the engine, the limiter comprising a temperature responsive element for positioning at the cylinder and a mechanical linkage from the temperature responsive element to the air inlet valve, wherein a portion of the limiter is suitably sized and shaped to be positioned between cooling fins on the cylinder.

2. A system as in claim 1 further comprising a magnet, at least a portion of the valve being comprised of ferromagnetic material and being pivotably connected to a frame with a fully closed position adjacent the magnet.

3. A system as in claim 1 wherein the valve includes a limiter receiving area with a portion of the mechanical linkage being located in the limiter receiving area, the valve being movable relative to the portion of the mechanical linkage between a first open position and a second closed position.

4. A system as in claim 3 wherein the limiter is movable between a first limiter position and a second limiter position, the first limiter position limiting the first open position of the valve to less than a fully open position and, the second limiter position limiting the second closed position of the valve to less than a fully closed position.

5. A system as in claim 1 wherein the mechanical linkage includes a lever pivotably connected to a frame and the temperature responsive element comprises a tie member adapted to contract when heated and expand back to its normal size when cooled, the tie member having a first end connected to the lever and a second end connected to the frame.

6. A system as in claim 1 wherein the temperature responsive element comprises a shape-memory alloy.

7. A system as in claim 6 wherein the shape-memory alloy is nitinol.

8. An air inlet control system for an internal combustion engine, the system comprising:

an air inlet valve having a first end adapted to substantially close an air inlet aperture and a second end with a limiter receiving area; and a temperature responsive limiter with a lever, a spring, a connector and a tie member, the lever having a first end located in the limiter receiving area, the tie member being connected to the lever and having an end for positioning at a predetermined portion of the engine, the tie member being comprised of a temperature responsive material with an elongate straight shape adapted to longitudinally contract when heated and expand back to its normal size when cooled, wherein the connector and spring are between the lever and the tie member with the spring biasing the connector in a first direction.

9. A system as in claim 8 further comprising a magnet located proximate the air inlet aperture and the first end of the valve being comprised of ferromagnetic material.

10. A system as in claim 8 wherein the second end of the valve has a general "L" shape.

11. A system as in claim 8 wherein the limiter further comprises a tube with the end of the tie member connected to a second end of the tube, and a first end of the tube being connected to a frame, the tie member extending through the tube.

12. A system as in claim 11 wherein the second end of the tube is suitably sized and shaped to be located between cooling fins on a cylinder of the engine.

13. A system as in claim 8 wherein the tie member is comprised of nitinol wire.

14. An internal combustion engine having a cylinder, a spark plug, a carburetor, and an air inlet control system for the carburetor, the control system comprising:

a magnet;

an air inlet valve movable between a fully open position and a fully closed position, the valve having a first ferromagnetic section adapted to be attracted by magnetic pull of the magnet when the valve is proximate its fully closed position, and a second section with a limiter receiving area; and a limiter having a limit member with a first end located in the limiter receiving area, the limit member being movable between a first position and a second position, the first position limits movement of the valve to include an open position that is less than the fully open position and, the second position limits movement of the valve towards the fully closed position.

15. An engine as in claim 14 wherein the valve is pivotably connected to a frame of an air filter.

16. An engine as in claim 14 wherein the limiter further includes a temperature responsive element connected to the limit member and a predetermined portion of the engine, the temperature responsive element moving the limit member based upon changes in temperature at the predetermined portion.

17. An engine as in claim 16 wherein the temperature responsive element comprises a tie member adapted to contract when heated.

18. An engine as in claim 14 wherein the first section of the valve is located in an air flow path to the carburetor and is adapted to substantially close an air inlet aperture to the carburetor when the valve is in the fully closed position.

19. An air inlet control system for an internal combustion engine, the system comprising:

an air inlet valve; and a limiter adapted to limit movement of the air inlet valve based upon temperature of a cylinder of the engine, the limiter including a limit member adapted to contact the air inlet valve and a tie member connected to the limit member, the tie member is comprised of a shape memory alloy with a portion extending between cooling fins on the cylinder.

20. A system as in claim 19 wherein the shape memory alloy is nitinol.

21. A system as in claim 20 wherein the tie member is a wire.

22. A system as in claim 19 further comprising a magnet, at least a portion of the valve being comprised of ferromagnetic material and being pivotably connected to a frame with a fully closed position adjacent the magnet.

23. An air inlet control system for an internal combustion engine, the system comprising:

an air inlet valve; and a temperature controlled limiter, the limiter being adapted to limit a range of movement of the inlet valve based upon temperature of a cylinder area of the engine, the limiter comprising a magnet, a temperature responsive element, and a mechanical linkage from the temperature responsive element to the air inlet valve, at least a portion of the valve being comprised of ferromagnetic material and being pivotably connected to a frame with a fully closed position adjacent the magnet.

* * * * *